US007234594B2

(12) United States Patent
Niimi

(10) Patent No.: US 7,234,594 B2
(45) Date of Patent: Jun. 26, 2007

(54) GOODS-DELIVERY BOX WITH EASILY BREAKABLE WALL AND METHOD OF DELIVERING GOODS

(75) Inventor: Naohiko Niimi, Shizuoka-ken (JP)

(73) Assignee: Yamaha Corporation, Shizuoka-ken (JP)

( * ) Notice: Subject to any disclaimer, the term of this patent is extended or adjusted under 35 U.S.C. 154(b) by 76 days.

(21) Appl. No.: 10/828,161

(22) Filed: Apr. 21, 2004

(65) Prior Publication Data

US 2005/0072839 A1 Apr. 7, 2005

(30) Foreign Application Priority Data

Jun. 23, 2003 (JP) ..... 2003-177811

(51) Int. Cl.
*A45C 11/00* (2006.01)

(52) U.S. Cl. ..... 206/314; 206/774; 229/240

(58) Field of Classification Search ..... 206/14, 206/314, 320, 521, 523, 586, 738, 774, 45.21, 206/576, 591–594; 229/200, 238, 240, 924
See application file for complete search history.

(56) References Cited

U.S. PATENT DOCUMENTS

| | | | | |
|---|---|---|---|---|
| 3,181,768 | A * | 5/1965 | Flynn et al. | 206/326 |
| 3,298,478 | A * | 1/1967 | Settimio | 206/314 |
| 3,355,089 | A | 11/1967 | Champlin | |
| 3,510,047 | A * | 5/1970 | Boehm | 229/240 |
| 4,483,444 | A * | 11/1984 | Gardner | 206/320 |
| 5,012,930 | A * | 5/1991 | Hansen | 229/240 |
| 5,188,285 | A * | 2/1993 | Nilsson et al. | 229/240 |
| 5,803,267 | A * | 9/1998 | Tu et al. | 206/586 |
| 5,957,294 | A * | 9/1999 | Kanter | 206/774 |
| 5,988,390 | A * | 11/1999 | McCoy | 206/586 |
| 6,290,126 | B1 * | 9/2001 | Zudal | 229/125.39 |
| 6,464,132 | B1 | 10/2002 | Duquet et al. | |
| 6,554,133 | B1 * | 4/2003 | Kropf et al. | 206/320 |

FOREIGN PATENT DOCUMENTS

| | | |
|---|---|---|
| DE | 91 09 981.1 | 11/1991 |
| DE | 102 03 977 A1 | 11/2002 |
| EP | 0 488 094 A1 | 6/1992 |
| EP | 0 899 201 A1 | 3/1999 |
| GB | 2 008 542 A | 6/1979 |
| JP | 54-26186 | 2/1979 |
| JP | 5-338689 | 12/1993 |
| JP | 7-257678 | 10/1995 |

OTHER PUBLICATIONS

European Search Report dated Sep. 15, 2004.

* cited by examiner

*Primary Examiner*—Luan K. Bui
(74) *Attorney, Agent, or Firm*—Dickstein Shapiro LLP

(57) ABSTRACT

A corrugated cardboard delivery box has a bottom wall, side walls front and rear walls and a pair of foldable lids, and an electronic piano is put in the delivery box together with pads in such a manner that the bottom board of the piano body is faced to the bottom wall; perforated lines are formed along the periphery of the bottom wall; when the package arrives at a purchaser's home, the deliveryman directs the bottom wall sideways, and detaches most of the bottom wall on the perforated lines by strongly pressing the periphery of the bottom wall so that the deliveryman can attach the legs to the piano body without taking out the piano body from the delivery box before taking out the piano body from the delivery box.

12 Claims, 10 Drawing Sheets

GOODS-DELIVERY BOX WITH EASILY BREAKABLE WALL AND METHOD OF DELIVERING GOODS

FIELD OF THE INVENTION

This invention relates to packaging technologies and, more particularly, to a delivery box and a method for delivering goods.

DESCRIPTION OF THE RELATED ART

When a manufacturer takes an order for goods, shipping clerks pack the goods in delivery boxes such as corrugated cardboard boxes, and, thereafter, forward the delivery boxes to the purchaser. Such delivery boxes are used for various manufactured goods such as household electric appliances.

A typical example of the delivery box is disclosed in Japanese Patent Application laid-open No. Hei 5-338689. The prior art corrugated cardboard delivery box is physically separated into a bottom frame and an enclosure. Two pairs of lids are provided around the upper portion of the enclosure. A pair of lower cushion parts is inserted into the bottom frame 11, and the electric washing machine is put on the lower cushion parts. The machine lids are made unmoved by means of a pair of upper pressing parts, and the enclosure is put on the electric washing machine so that the electric washing machine is enclosed with the enclosure. Finally, the upper opening is closed with the two pairs of lids. Thus, the lower frame is not secured to the enclosure. Accordingly, when the electric washing machine is taken out from the prior art corrugated cardboard delivery box, user pulls up the enclosure so as to remove it from the electric washing machine. Then, the electric washing machine is left on the group together with the pair of lower cushion pairs in the bottom frame.

Another prior art delivery box is disclosed in Japanese Patent Application laid-open No. Hei 7-257678. The prior art delivery box is designed for a keyboard musical instrument. The keyboard musical and a stand are packed in the prior art delivery box. The prior art delivery box has a bottom and two pairs of lids. The stand, which is enclosed with the inner pad, is put onto the bottom of the prior art delivery box, and the keyboard musical instrument, which is enclosed in the center pad, is stacked on the stand. The pair of side pads is inserted into the side spaces between the keyboard musical instrument and the delivery box, and the upper opening is closed with the two pairs of lids. When the user takes out the keyboard musical instrument and stand from the prior art delivery box, the user opens the two pairs of lids, and takes out the keyboard musical instrument and stand from the prior art delivery box, and attaches the stand to the musical instrument. Thus, the keyboard musical instrument and stand are put into and taken out from the prior art delivery box through the upper opening, and, any part of the prior art delivery box is not broken.

In order to make the package compact, bulky goods are usually disassembled into plural parts before the packaging. An electronic piano stands on the floor with legs, by way of example. If the manufacturer wishes to pack the complete electronic piano in a delivery box, a large-sized delivery box is required for the complete electric piano. The large-sized delivery box is expensive, and occupies wide space during the transportation. For this reason, the legs are usually separated from the piano cabinet, and the piano cabinet and legs are packed in a middle-sized delivery box together with other component parts. The middle-sized package is conveyed to user's house through a distributor. When the middle-sized package reaches purchaser's home, the deliverymen take out the parts of the electronic piano, i.e., the piano cabinet, legs and so forth from the delivery box, and assemble those parts into the electronic piano.

The deliverymen usually proceed with the unpacking/assembling works as follows. First, the deliverymen put the middle-sized package such that the bottom of the piano cabinet is directed to the floor. The deliverymen peel off the pieces of the packaging tape from the upper lids, which are usually double-leafed lids swingably connected to the upper edges of the delivery box, untie the strings anchored at the upper lids, or remove staples implanted into the upper lids. When the pieces of packaging tape, strings or staples are removed, the deliverymen unfold the two pairs of lids, and open the delivery box. Then, the deliverymen become accessible to the electronic piano in the delivery box.

The deliverymen take out all the parts of the electronic piano through the upper opening of the delivery box, and put them on the floor. Subsequently, the deliverymen make the piano cabinet topple down sideways. Then, the bottom board of the piano cabinet is faced to the deliverymen so that the deliverymen attach the legs to the bottom board of the piano cabinet. Finally, the deliverymen raises up the electronic piano, and move the electronic piano to a place instructed by the user.

A problem is encountered in the prior art delivery box in that the deliverymen take much time for the unpacking. The two double-leafed lids were folded, and the upper double-leafed lids were tied with the staples, strings or pieces of packing tape. The deliverymen need to oppositely trace those packing steps for taking out the electronic piano. Thus, the unpacking work is time-consuming, and the deliverymen take much time.

Another problem inherent in the prior art delivery work, i.e., packing, unpacking and assembling work are that the manufactured goods are liable to get hurt. The manufactured goods were packed in the delivery package, and have been conveyed to the purchaser's home. These are the steps of the packing work. The deliverymen take out the piano cabinet, legs etc. from the delivery box, and put them on the floor. These are the steps of the unpacking work. Thereafter, the deliverymen topple down the piano cabinet sideways, attach the legs to the bottom board of the piano cabinet, and raise up the piano cabinet. The piano cabinet is fairly bulky and heavy so that the deliverymen need to concentrate their attention to the piano cabinet. The deliverymen are less liable to pay attention to the obstacles around the piano cabinet. For this reason, when the deliverymen topple down and raise up the piano cabinet, they sometimes hit the piano cabinet against the obstacle, and hurt the piano cabinet.

SUMMARY OF THE INVENTION

It is therefore an important object of the present invention to provide a delivery box, from which goods are easily taken out.

It is also an important object of the present invention to provide a method of delivering goods, through which deliverymen complete the delivery work without the hurt to goods.

The present inventor contemplated the problems inherent in the prior art, and noticed that the delivery package was used only once. The purchasers usually handed over the delivery box to a garbage man. In other words, there was no problem even if the deliverymen broke the delivery box. The present inventor concluded that the deliverymen would appreciate a breakable wall forming a part of the delivery box.

The present inventor further noticed that, if the goods had been turned sideways in the delivery box, the deliverymen could attach other parts to the bottom board immediately after the breakable wall was removed from the delivery box. The present inventor concluded that the goods were to be put in the delivery boxes in such a manner that the surfaces, to which other parts were to be attached, were faced to the breakable walls.

To accomplish the first object, it is proposed to form a breakable wall in a delivery box.

To accomplish the second object, it is proposed to make a surface on which a work is to be conducted faced to the breakable wall.

In accordance with one aspect of the present invention, there is provided a delivery box for packing goods separable into a body and at least one attachment therein comprising plural walls defining an inner space where at least the body is received, and a breakable wall connected to the plural walls, faced with a portion of the body where the aforesaid at least one attachment is to be connected and having a breakable route weaker than a remaining portion of the breakable wall.

In accordance with another aspect of the present invention, there is provided a method for delivering goods comprising the steps of a) packing at least a body in a delivery box having plural walls and a breakable wall in such a manner that a part of the body, to which at least one attachment is connected, is faced to the breakable wall, b) making the delivery box stand on one of the plural walls so that the breakable wall is directed to a worker, c) removing the breakable wall from the delivery box so that the part of the body is exposed to the outside of the delivery box, d) connecting the aforesaid at least one attachment to the part of the body, and e) removing a remaining portion of the delivery box from the body.

BRIEF DESCRIPTION OF THE DRAWINGS

The features and advantages of the delivery box and method will be more clearly understood from the following description taken in conjunction with the accompanying drawings, in which.

DESCRIPTION OF THE PREFERRED EMBODIMENTS

Figure 1:
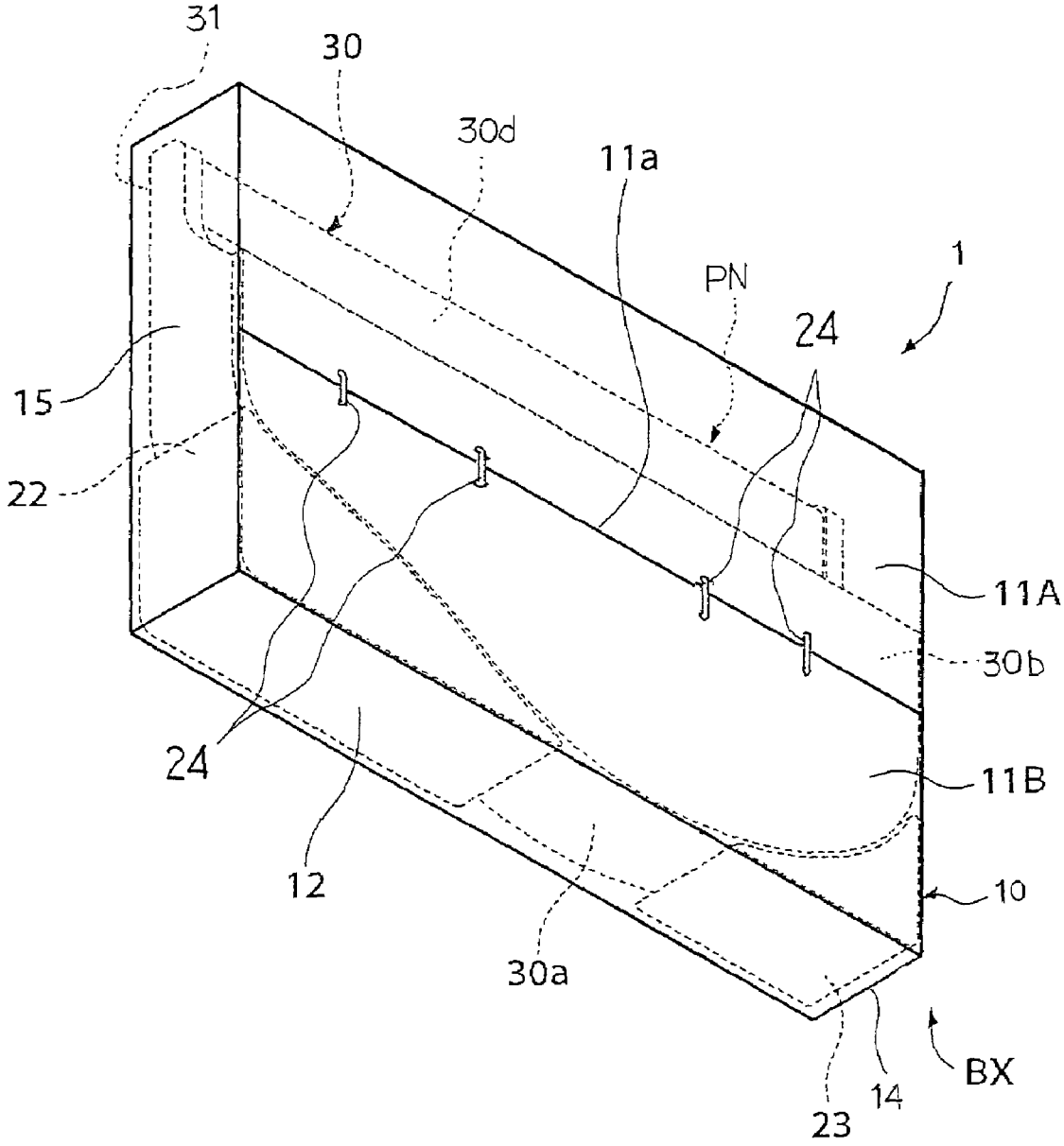
FIG. 1 is a perspective view showing the structure of a corrugated cardboard delivery box according to the present invention.

A delivery box embodying the present invention has plural walls and a breakable wall. The plural walls and breakable wall define an inner space, and goods are to be received therein. One of the most popular contours of the delivery box is a rectangular parallelepiped configuration. However, another delivery box embodying the present invention may be partially rounded.

One of the plural walls may be formed by a pair of foldable lids, a single foldable lid or two pairs of foldable lids. The pair of foldable lids, single foldable lid or two pairs of foldable lids offer an opening to a worker. When the worker packs the good in the delivery box, the foldable lid or lids are opened, and the worker puts the goods in the inner space of the delivery box. However, when the worker unpack the goods from the delivery box, he or she does not unfold the lid or lids, and takes out the goods through an opening from which the breakable wall was removed. The lid or lids may be connected to each other or to the other walls by means of staples, pieces of packing tape or strings. A cap may be used as one of the plural walls. The cap is attached to or detached from the remaining portion of the delivery box. When the goods are received in the inner space, the cap is attached, and is secured to the remaining portion of the delivery box.

The breakable wall has a breakable route and a remaining portion. The remaining portion is connected through the breakable route to some of the plural walls. The breakable route is weaker than the remaining portion so that a deliverymen or user can easily detach the remaining portion on the breakable route without a tool such as a knife. However, the breakable wall is not so strong as the plural walls. The delivery box may be reinforced with bands after the packing.

Perforated lines, lines of dots, narrow grooves or a string adhered to the inner surface of the breakable wall serve as the breakable route. A worker or user tears the remaining portion at the perforated lines, lines of dots, narrow grooves or the string by strongly pressing the remaining portion or pulling the string. These breakable routes will be hereinlater described in detail with reference to the drawings.

Corrugated cardboard is desirable for the delivery box. However, another sort of patterned sheet of paper or a patterned sheet of synthetic resin is available for the delivery box.

Pads may be inserted between the goods and the inner surfaces of some walls. The pads prohibit the goods from moving during transportation. Moreover, the pads keep the goods stable during an assemblage so as to make the assemblage easy and smooth.

The goods are delivered as follows. First, deliverymen firstly pack the goods in the delivery box. In case where a pair of foldable lids form in combination one of the plural walls, the foldable lids are opened, and the goods are put inside the delivery box through the opening. The pads may be inserted into the gap between the goods and the inner surface of the delivery box. The lid or lids are folded up, and staples are implanted into the lids. The delivery box may be banded with pieces of synthetic resin tape.

When the package arrives at a purchaser's home, the deliverymen or users direct the breakable wall to them. This means that the delivery box does not stand on the breakable wall. The deliverymen or users break the breakable wall along the breakable route, and remove most of the breakable wall from the delivery box. Then, the part of the body is exposed to the outside of the delivery box.

The deliverymen or users assemble the attachment to the part of the body, and complete the goods. Finally, the deliverymen or users remove the remaining portion of the delivery box from the goods.

As will be appreciated, the goods are taken out from the delivery box after the removal of the breakable wall. The deliveryman or user removes the breakable wall by strongly depressing the breakable route or pulling the string. Thus, the unpacking work is simple and easy.

Moreover, the body and attachment are assembled in the goods before the removal of the remaining portion of the delivery box from the body. For this reason, the body is less liable to be hurt.

FIRST EMBODIMENT

Figure 2:
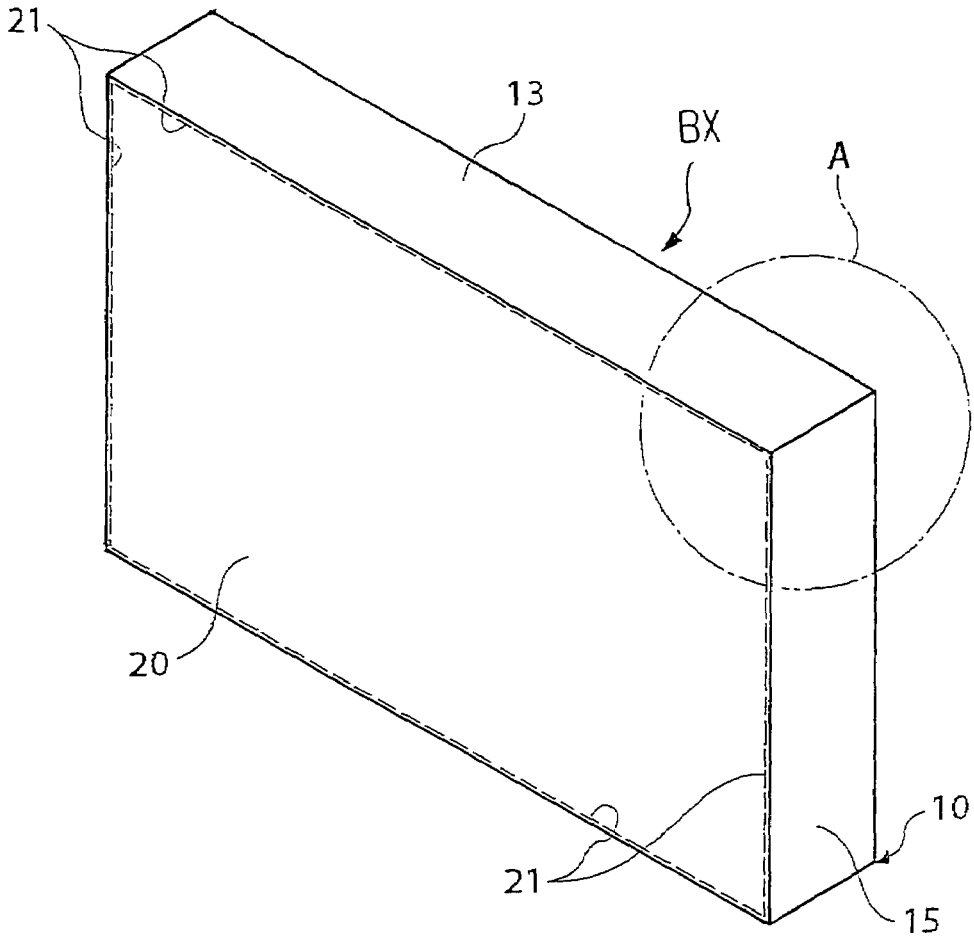
FIG. 2 is a perspective view showing a breakable wall of the corrugated cardboard delivery box according to the present invention.
Figure 3:
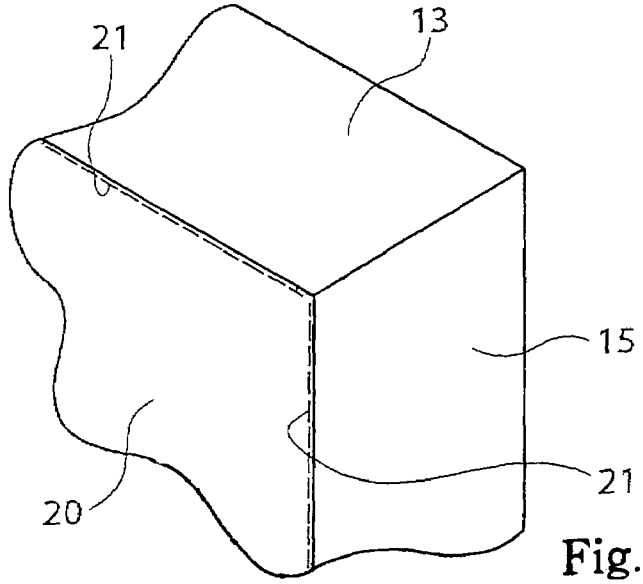
FIG. 3 is a perspective view showing a corner of the corrugated cardboard delivery box encircled with dot-and-dash line A in FIG. 2.

Referring to FIGS. 1, 2 and 3 of the drawings, a package 1, which is to be delivered to a purchaser, gets ready for transportation. The package 1 comprises a corrugated cardboard box BX, manufactured goods such as an electronic piano PN and pads 22/23. The electronic piano PN includes a piano body 30, legs 33A/33B/33C (see FIG. 7), other component parts (not shown) and accessories (not shown). In this instance, the legs 33A/33B/33C are packed separately from the piano body 30, and are attached to and detached from the piano body 30.

The electronic piano body 30 has a contour like a piano cabinet of a standard grand piano. In the following description on the electronic piano PN, terms "lower" and "bottom" are indicative of positions closer to a floor, on which the electronic piano PN stands, than a position modified with term "upper" and "top". Term "front" is indicative of a position closer to a pianist who is fingering a piece of music on the electronic piano PN than a position modified with term "rear". On the other hand, the parts of the corrugated cardboard delivery box BX are modified with terms "front", "rear", "upper/top" and "lower/bottom" in such a manner that the piano body 30 has been already put in the corrugated cardboard delivery box BX. The parts, which are faced with the front board, rear board, upper/top board and lower/bottom board of the piano body 30, are also modified with terms "front", "rear", "upper/top" and "lower/bottom", respectively.

A side board 30*a*, a top board 30*b*, a bottom board 31 and a front board 30*c* (see FIG. 5) are assembled into the piano body 30. The side board 30*a* is curved like a wing, and defines the side extent and rear extent of the piano body 30. The side board 30*a* is sandwiched between the top board 30*b* and the bottom board 31. The top board 30*b* defines the upper extent of the piano body 30, and the bottom board 31 defines the lower extent of the piano body 30. The front board 30*c* is hung from the front end of the top board 30*b*, and the top board 30*b* is shorter than the bottom board 31. This means that the front portion of the bottom board 31 projects from the lower end of the front board 30*c*. A keyboard 30*d* is mounted on the front portion of the bottom board 31, and is connected to key switches (not shown). The key switches (not shown) are housed in the piano body 30 together with a tone generating module (not shown), a sound unit (not shown) and loud speakers (not shown).

The corrugated cardboard delivery box BX has a rectangular parallelepiped configuration, and is divisible into an upper folded structure 10 and a bottom wall 20. The upper folded structure 10 includes a rear wall 12, a front wall 13, side walls 14/15 and a pair of foldable lids 11A/11B. The rear wall 12, front wall 13 and side walls 14/15 form in combination the periphery of the corrugated cardboard delivery box BX, and the upper ends of these peripheral walls 12/13/14/15 define an upper opening. The foldable lids 11A/11B are respectively connected to the upper ends of the front and rear walls 13/12. Although the upper opening is closed with the pair of foldable lids 11A/11B in FIG. 1, the pair of foldable lids 11A/11B is unfolded so as to expose the inner space of the corrugated cardboard delivery box BX through the upper opening to the outside. The piano body 30, other component parts and accessories are put into the inner space through the upper opening together with the pads 22/23. When the piano body 30, other component parts and accessories are put in the corrugated cardboard delivery box BX, the worker inserts the pads 22/23 into the gaps between the inner surface of the corrugated cardboard delivery box BX and the piano body 30, and unfolds the foldable lids 11A/11B. The pads 22/23 are anchored at the corrugated cardboard delivery box BX. Finally, the worker implants staples 24 into the lids so that the staples 24 keep the foldable lids 11A/11B closed. The pads 22/23 prevent the piano body 30 from undesirable rattling, and keeps the piano body 30, other component parts and accessories stable inside the corrugated cardboard delivery box BX during transportation. Some component parts and accessories may be wrapped in the pads 22/23.

The lower ends of the front, rear and side walls 13/12/14/15 are contiguous to a bottom wall 20, and the bottom wall 20 is perforated along the peripheral walls 12/13/14/15, and the perforated lines are labeled with reference numeral 21 in FIGS. 2 and 3. The bottom wall 20 is so week along the perforated lines 21 that a worker can easily tear most of the bottom wall 20 at the perforated lines 21 without assistance of a tool. Term "breakable wall" means a part of a delivery box easily breakable without any tool. Thus, the bottom wall 20 serves as a breakable wall. When most of the bottom wall 20 is tore, a lower opening takes place, and is wide enough to take the piano body 30 from the inner space.

Description is hereinafter made on a delivery work. In this instance, the delivery work contains at least an unpacking and an assembling. However, the description starts at a packing stage.

Figure 4:
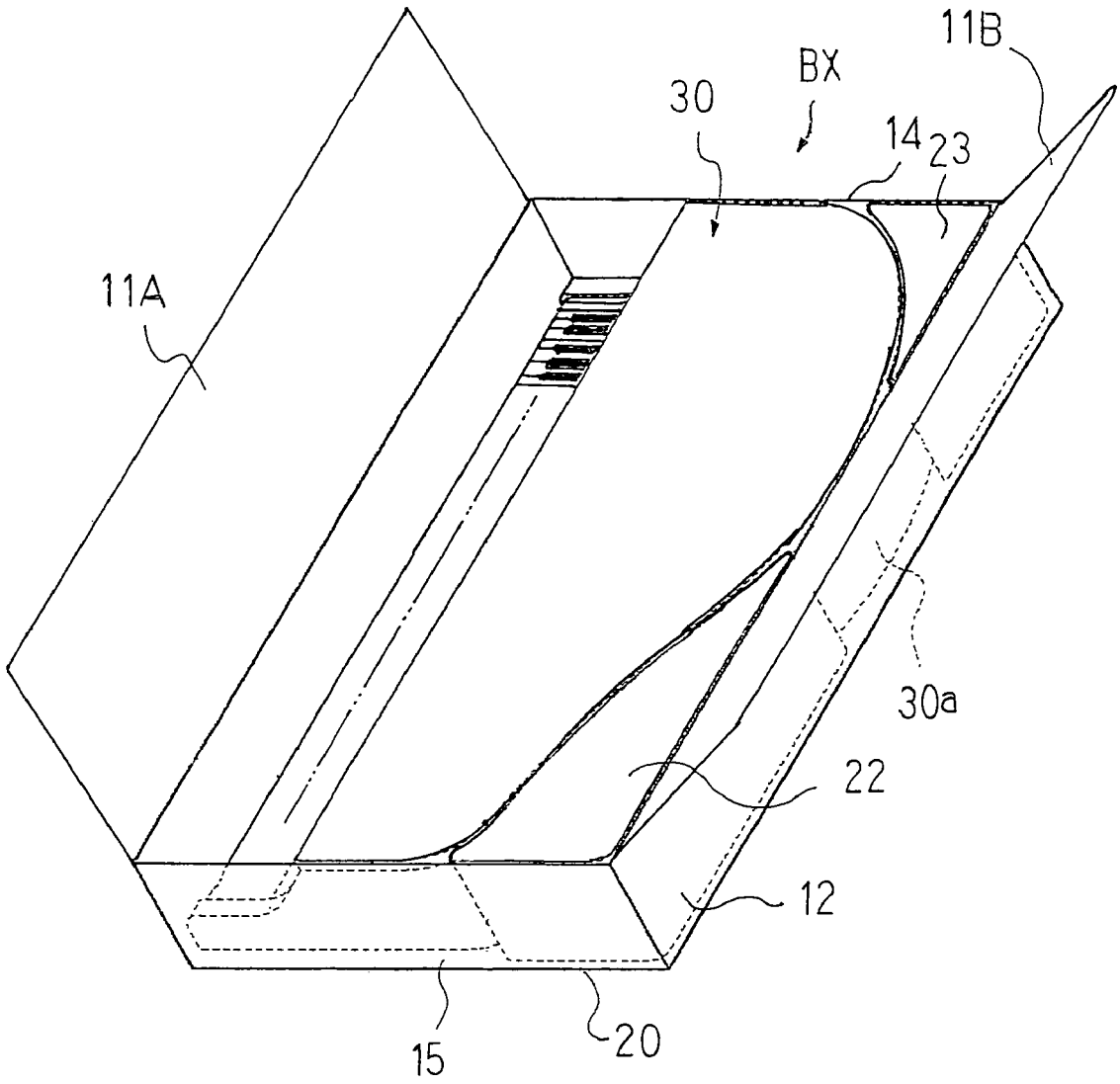
FIG. 4 is a perspective view showing a piano body put in the delivery box at a packing stage.

The delivery work starts with preparation of the corrugated cardboard delivery box BX. The perforated lines 21 are not broken, and, accordingly, the bottom wall 20 is connected to the upper folded structure 10. The corrugated cardboard delivery box BX is placed on a working table (not shown), and the foldable lids 11A/11B are open. Deliverymen put the piano body 30 into the corrugated cardboard delivery box BX together with the other component parts and accessories. Since the piano body 30 has the contour like a wing, the side board 30*a* is spaced from the rear/side walls 12/14/15 around the rear corners, the pads 22/23 are inserted into the spaces, and are secured to the inner surface of the corrugated cardboard delivery box BX as shown in FIG. 4. The pads 22/23 keep the piano body 30 stable in the corrugated cardboard delivery box 30 during transportation, and prevent the piano body 30 from undesirable rocking motion at the assembling stage as will be described hereinlater.

Figure 5:
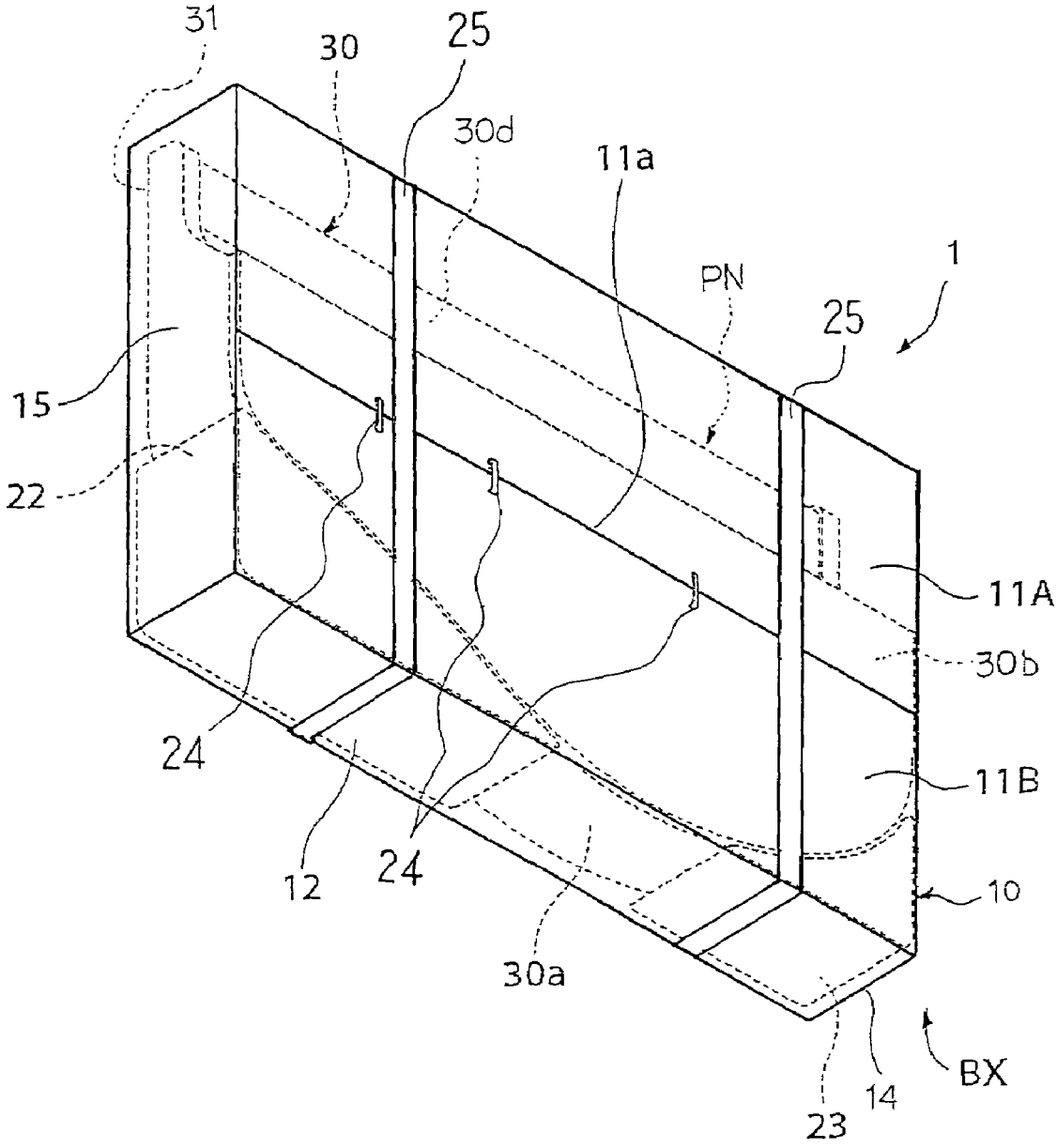
FIG. 5 is a perspective view showing a package ready for transportation.

Subsequently, the deliverymen fold up the foldable lids 11A/11B. The foldable lids 11A/11B abut along line 11*a*, and the deliverymen implant staples 24 into the foldable lids 11A/11B (see FIG. 1). The staples 24 prevent the foldable lids 11A/11B from unfolding. Finally, the corrugated cardboard delivery box BX is banded as shown in FIG. 5. The packing bands 25 are made of synthetic resin, and prohibit the bottom wall 20 from unintentional breakage. Thus, even if the manufactured goods are heavy, the bottom wall 20 is never tore during the transportation by virtue of the packing bands 25.

The deliverymen convey the package 1 to a purchaser's home. When the package 1 arrives at the purchaser's home, the deliverymen carry the package in a room, and start the unpacking work. First, the deliverymen untie the packing bands 25. However, the deliverymen do not remove the staples 24 from the foldable lids 11A/11B. The deliverymen make the corrugated cardboard delivery box BX topple down sideways so that the rear wall 12 is held in contact with the floor. In other words, the corrugated cardboard delivery box BX stands on its rear wall 12. The corrugated cardboard delivery box BX may stand on its front or side wall 13/14/15 instead of the rear wall 12. While the deliverymen is directing the corrugated cardboard delivery box BX sideways, the corrugated cardboard delivery box BX may be brought into collision with an obstacle. However, the corrugated cardboard delivery box BX prevents the piano case 30 from the impact. For this reason, the piano case 30 is not hurt.

Figure 6:
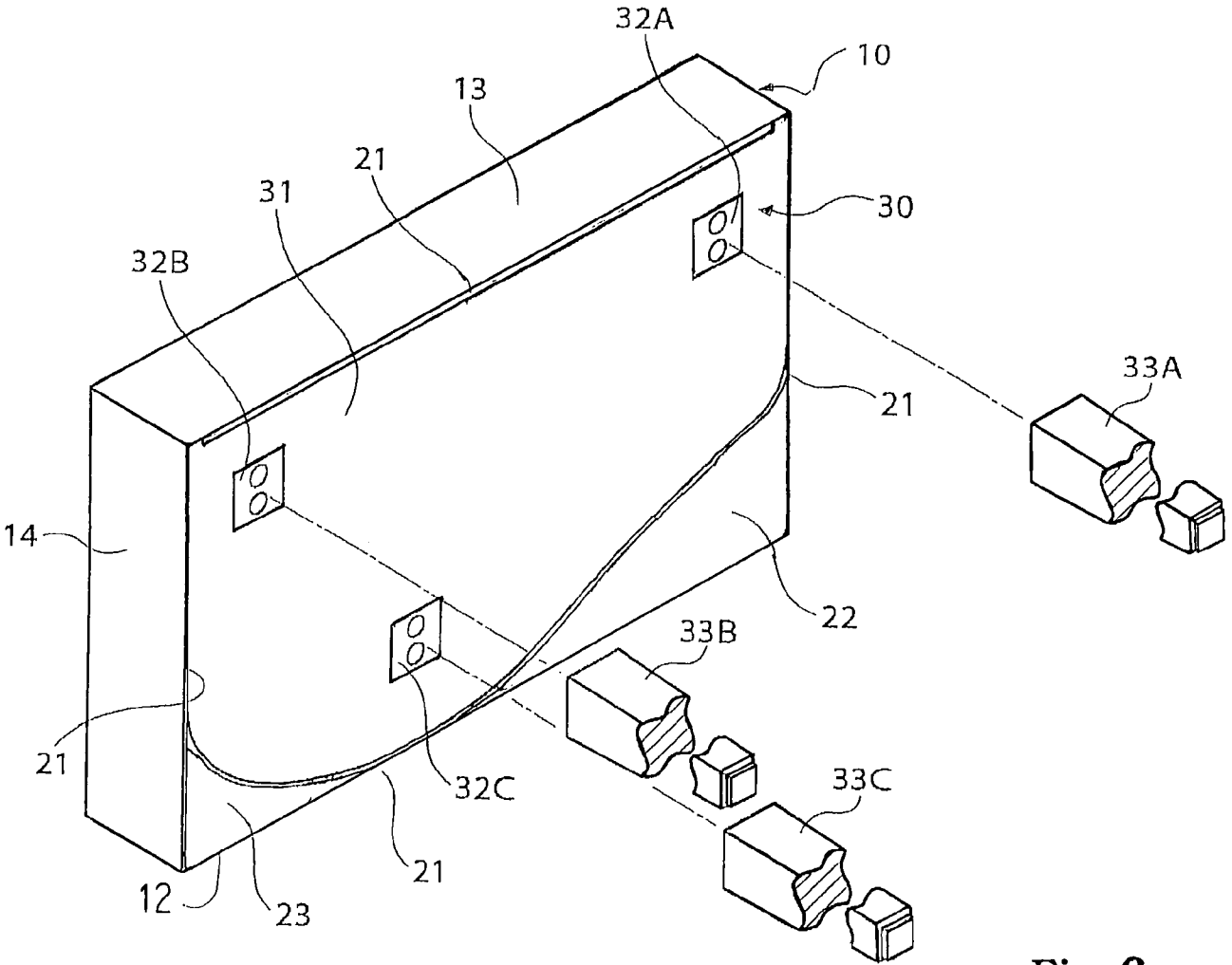
FIG. 6 is a perspective view showing the piano body at an unpacking stage.

Subsequently, the deliverymen detach most of the bottom wall 20 on the perforated lines 21. When the deliverymen strongly push the bottom wall 20 at the perforation, the bottom wall 20 is broken along the perforated lines 21, and most of the bottom wall 20 is tore. For this reason, the deliverymen easily remove the bottom wall 20 without any tool, and the lower surface of the bottom board 31 is exposed to the outside through the lower opening as shown in FIG. 6. The pads 22/23 do not allow the piano body 30 to rock in the corrugated cardboard delivery box BX. Thus, the piano body 30 is stable in the corrugated cardboard delivery box BX.

The assembling work starts with separation of the legs 33A/33B/33C. Coupling plates 32A/32B/32C were secured to the lower surface of the bottom board 31, and are exposed to the outside. The deliverymen align the legs 33A/33B/33C with the coupling plates 32A/32B/32C, respectively, and secure the legs 33A/33B/33C to the coupling plates 32A/32B/32C.

Figure 7:
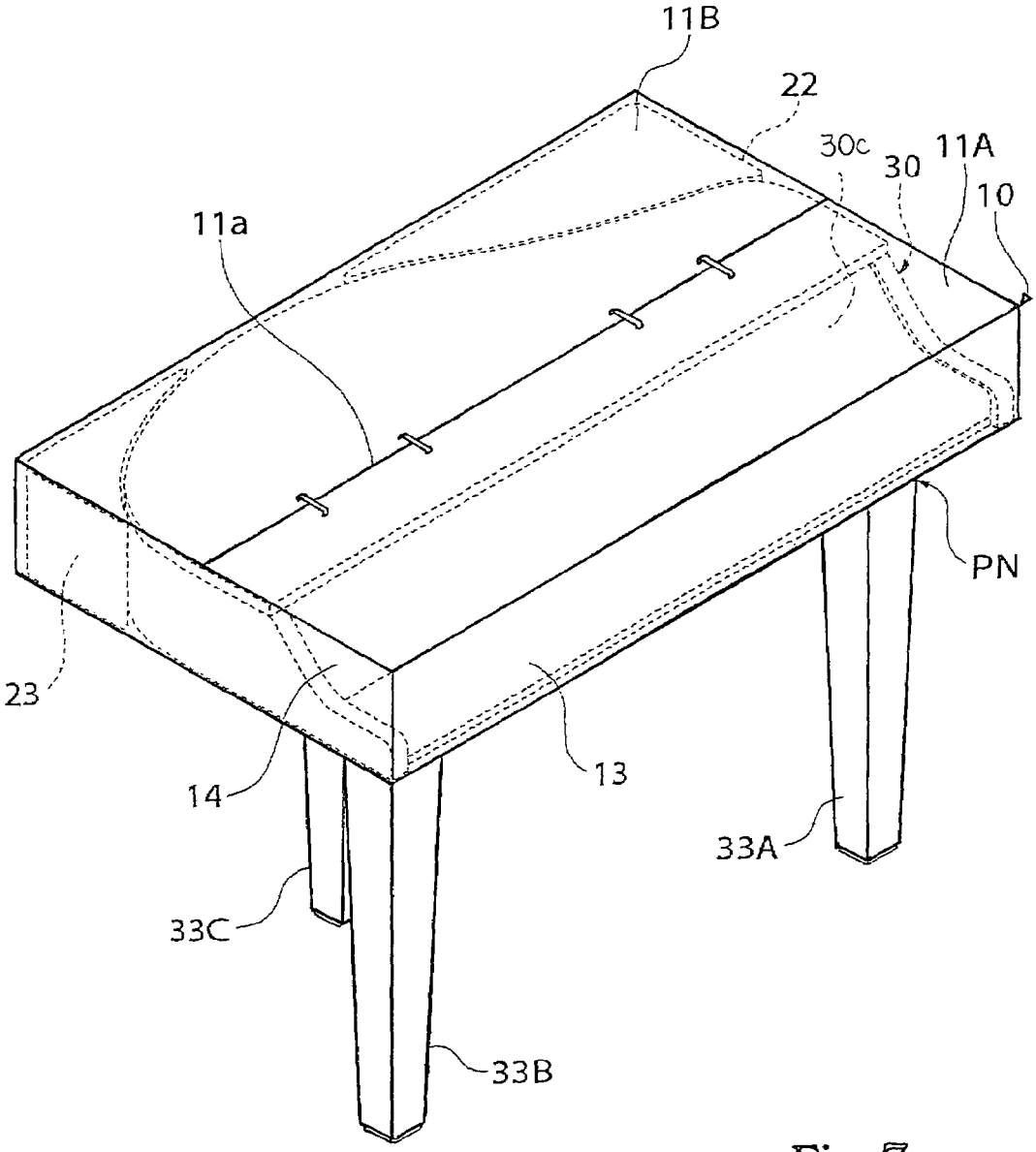
FIG. 7 is a perspective view showing the electronic piano at an assembling stage.

When the legs 33A/33B/33C are secured to the bottom board 31, the deliverymen raise up the electronic piano PN, and make the electronic piano PN stand on its legs 33A/33B/33C as shown in FIG. 7. While the deliverymen are raising up the electronic piano PN, the electronic piano PN may be hit with an obstacle. However, the piano case 30 is still covered with the upper folded structure 10 so that the piano case 30 is not hurt.

Finally, the deliverymen pull up the upper folded structure 10 over the electronic piano PN. The pads 22/23 are removed together with the upper folded structure 10, and the electronic piano PN is left on the floor.

As will be understood from the foregoing description, the delivery box BX according to the present invention has the breakable wall 20, and the workers tear the breakable wall 20 at the perforated lines 21 by strongly pressing the periphery of the bottom wall 20 with their fingers. This results in the smooth unpacking work. Thus, the first object is accomplished with the delivery box BX according to the present invention.

While the deliverymen is unpacking and assembling the manufactured goods, the piano body 30 is covered with the upper folded structure 10, and the upper folded structure 10 prevents the piano body 30 from obstacles. For this reason, the electronic piano PN is less liable to be hurt. Thus, the second object is accomplished through the delivery method according to the present invention.

The pads 22/23 are advantageous in that they keep the piano body 30 stable during the attachment of the legs 33A/33B/33C to the bottom board 31. From this point of view, it is desirable to insert pads between goods and a wall on which the delivery box stands. If goods have a complicated contour, more than two pads may be inserted into the goods and the delivery box.

The perforated lines 21 are routed along the periphery of the bottom wall 20. This feature is another secondary advantage, because the deliverymen easily removes the upper folded structure 10 from the electronic piano PN by simply pulling up.

SECOND EMBODIMENT

Figure 8:
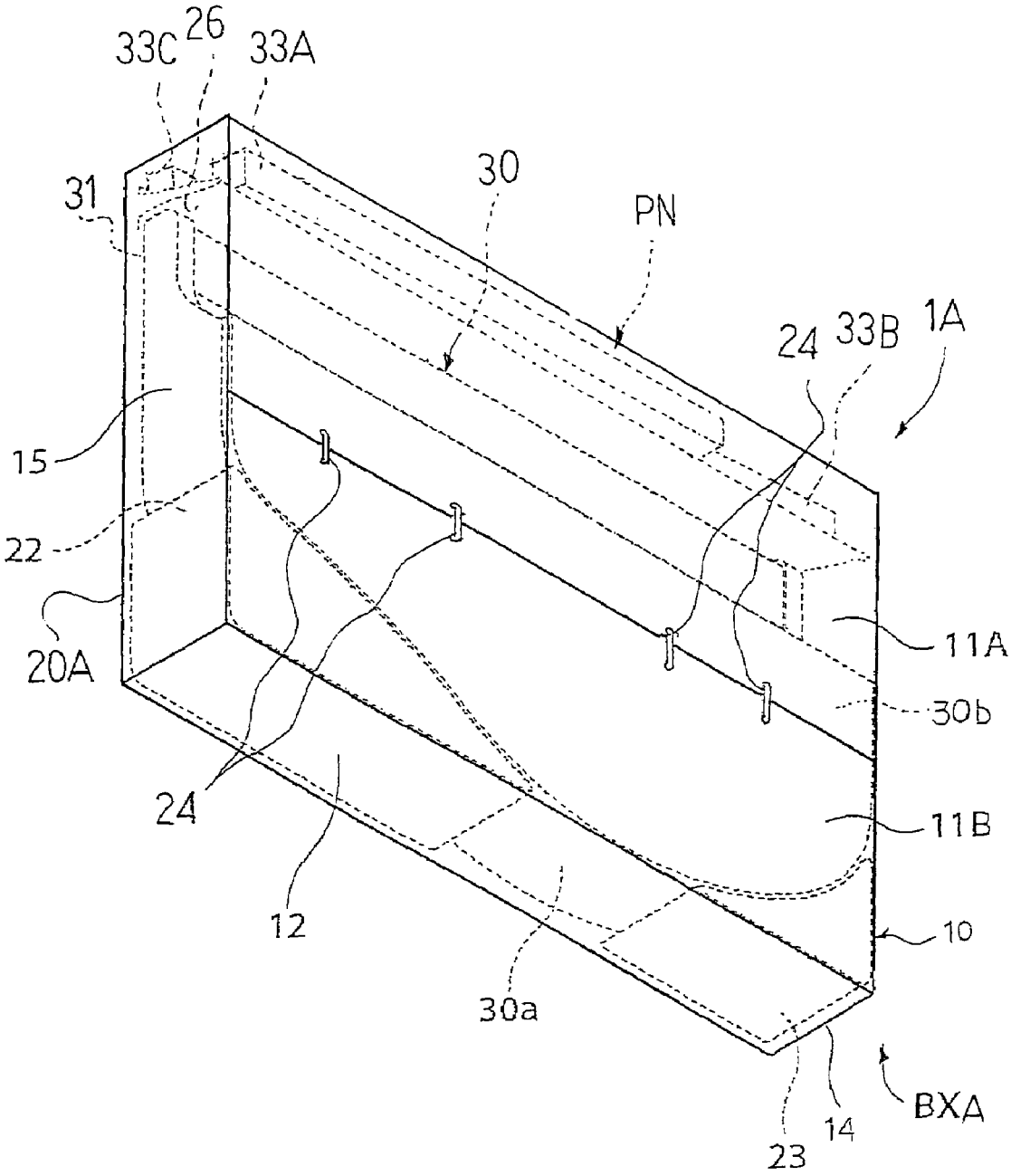
FIG. 8 is a perspective view showing the structure of another corrugated cardboard delivery box according to the present invention.

Turning to FIG. 8 of the drawings, another package 1A includes a corrugated cardboard delivery box BXA, pads 22/23, a partition board 26 and an electronic piano PN. The electronic piano PN and pads 22/23 are same as those described in conjunction with FIGS. 1 to 7, and, for this reason, description is omitted for the sake of simplicity. The component parts of the electronic piano PN are labeled with references designating the corresponding component parts of shown in FIGS. 1 to 7.

The corrugated cardboard delivery box BXA is slightly larger than the corrugated cardboard delivery box BX, and not only the piano body 30 but also the legs 33A/33B/33C are put in the corrugated cardboard delivery box BXA. In detail, the legs 33A/33B/33C are inserted into the additional space in the corrugated cardboard delivery box BXA, and the partition board 26 is provided between the piano body 30 and the legs 33A/33B/33C. Though not shown in FIG. 8, the perforated lines 21 are routed along the periphery of the bottom wall 20A.

The delivery work is slightly different from that described in conjunction with the above-described delivery work. The deliverymen pack the legs 33A/33B/33C in the corrugated cardboard delivery box BXA together with the piano body 30. The partition board 26 prevents the piano body 30 and legs 33A/33B/33C from abrasion and scratch. The package 1A may be banded as similar to the package 1.

When the package 1A arrives at a purchaser's home, the deliverymen unpack the package 1A, and assemble the piano body 30 and legs 33A/33B/33C into the electronic piano PN. In detail, the bands are untied from the package 1A, and the deliverymen make the package 1A stand on its rear wall 12. Subsequently, the deliverymen strongly press the periphery of the bottom wall 20A, and tear most of the bottom wall 20A at the perforated lines 21. The deliverymen take out the legs 33A/33B/33C from the corrugated cardboard delivery box BXA, and attach the legs 33A/33B/33C to the coupling plates, which have been already secured to the lower surface of the bottom board of the piano case 30.

Finally, the deliverymen raise up the electronic piano PN, and pull up the upper folded structure 10 so as to remove it from the piano case 10.

The deliverymen accomplish the first and second objects by using the corrugated cardboard delivery box BXA through the method of delivering as similar to the first embodiment.

Moreover, the corrugated cardboard delivery box BXA is desirable, because the deliverymen can pack all the component parts of the electronic piano therein.

Although particular embodiments of the present invention have been shown and described, it will be apparent to those skilled in the art that various changes and modifications may be made without departing from the spirit and scope of the present invention.

Figure 9:
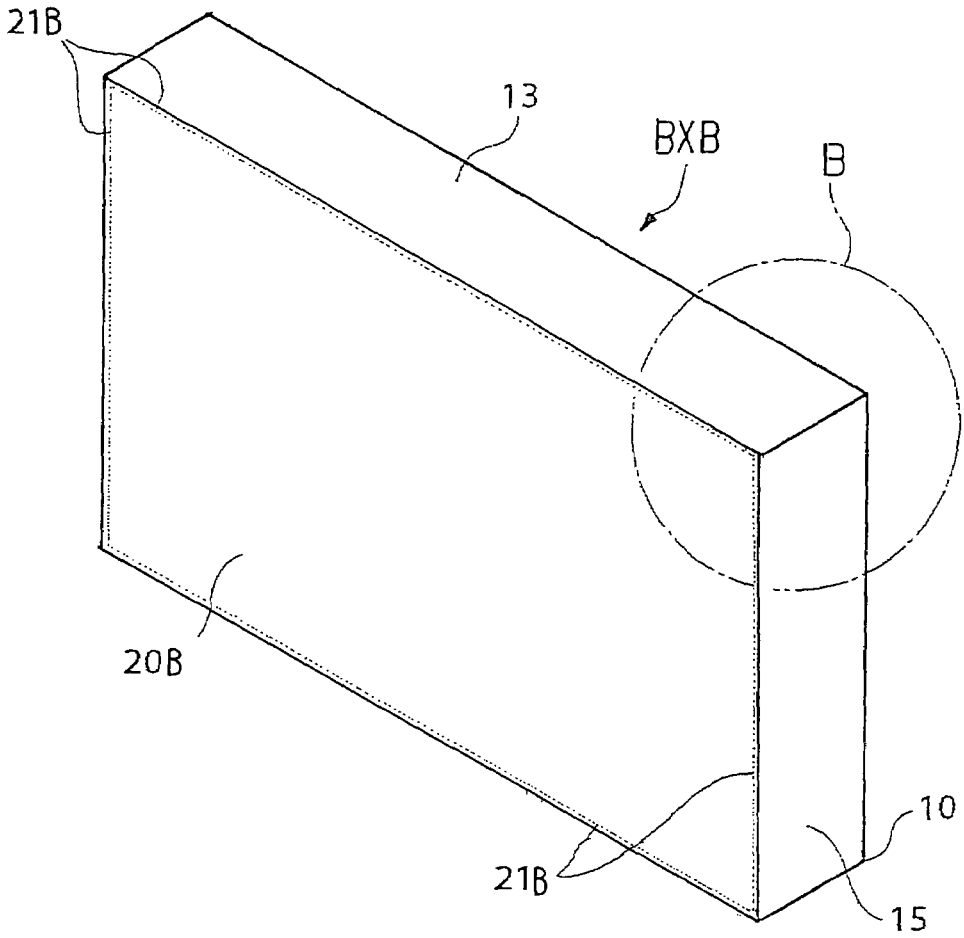
FIG. 9 is a perspective view showing a breakable wall of yet another corrugated cardboard delivery box.
Figure 10:
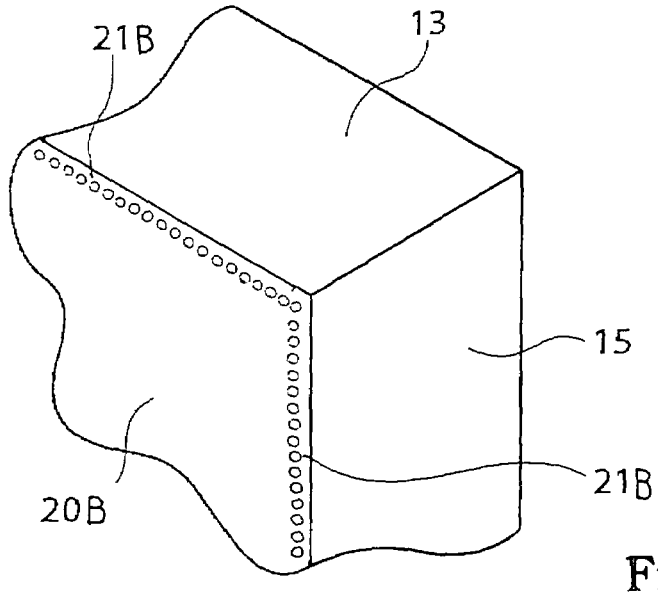
FIG. 10 is a perspective view showing a corner of the corrugated cardboard delivery box encircled with dot-and-dash line B in FIG. 9.

The perforated lines 21 do not set any limit to the technical scope of the present invention. Another delivery box may have a breakable wall 20B to be tore at lines of dots 21B as shown in FIGS. 9 and 10. The lines of dots 21B make the breakable wall 20B stronger than the perforated lines 21 do.

Figure 11:
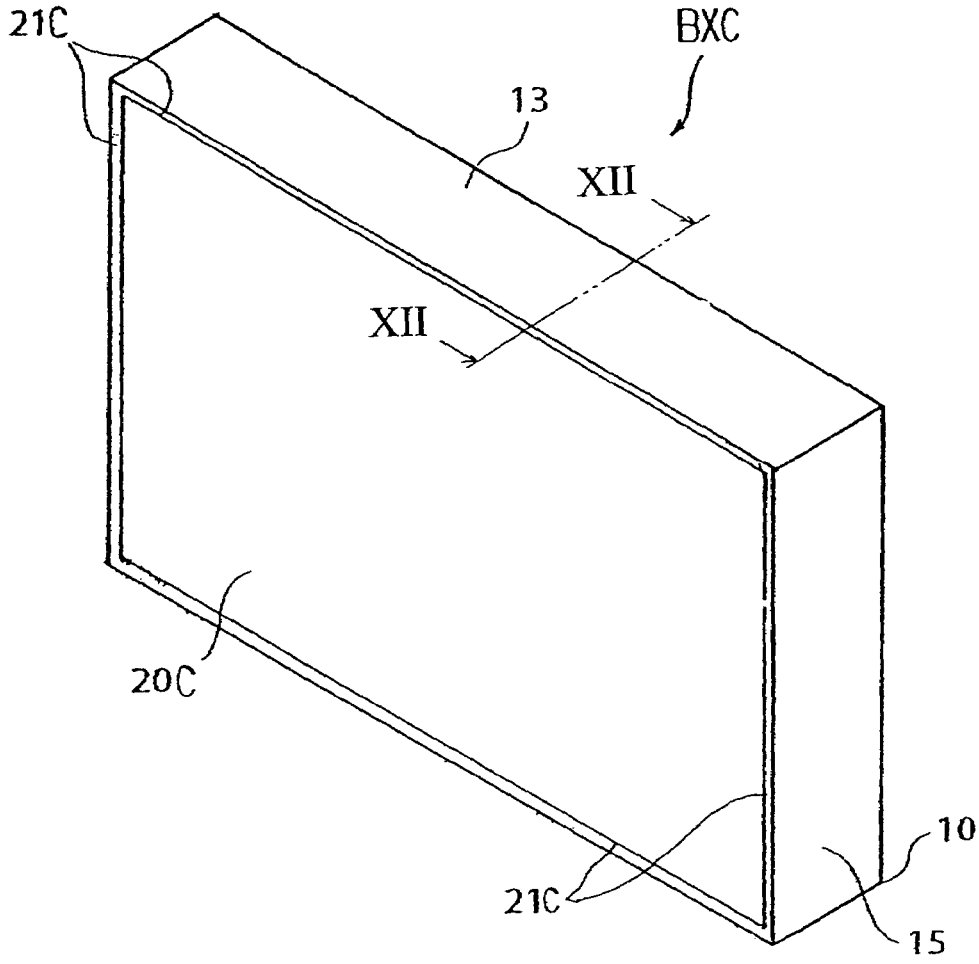
FIG. 11 is a perspective view showing a breakable wall of still another corrugated cardboard delivery box.
Figure 12:
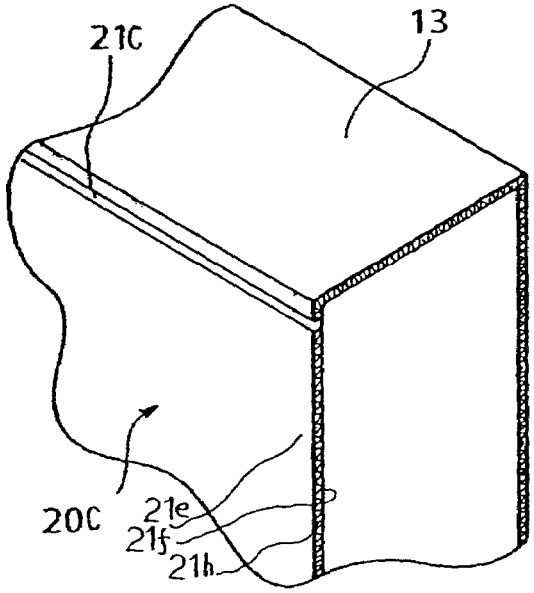
FIG. 12 is a cross sectional perspective view taken along line II—II in FIG. 11 and showing a breakable line.

FIGS. 11 and 12 show another breakable wall 20C of still another corrugated cardboard delivery box BXC according to the present invention. The corrugated cardboard usually has a pair of sheets of paper 21*e*/21*f* and a small bellows 21*h*. One of the sheets of paper 21*e*/21*f* is partially cut away so that a narrow groove 21C is formed along the periphery of the breakable wall 20C. When the deliverymen strongly press the peripheral area of the breakable wall 20C, the remaining sheet of paper 21*f* is broken, and most of the breakable wall 20C is detached from the corrugated cardboard box BXC on the narrow grooves 21C. Thus, the narrow grooves 21C make the wall 20C easily breakable.

Figure 13:
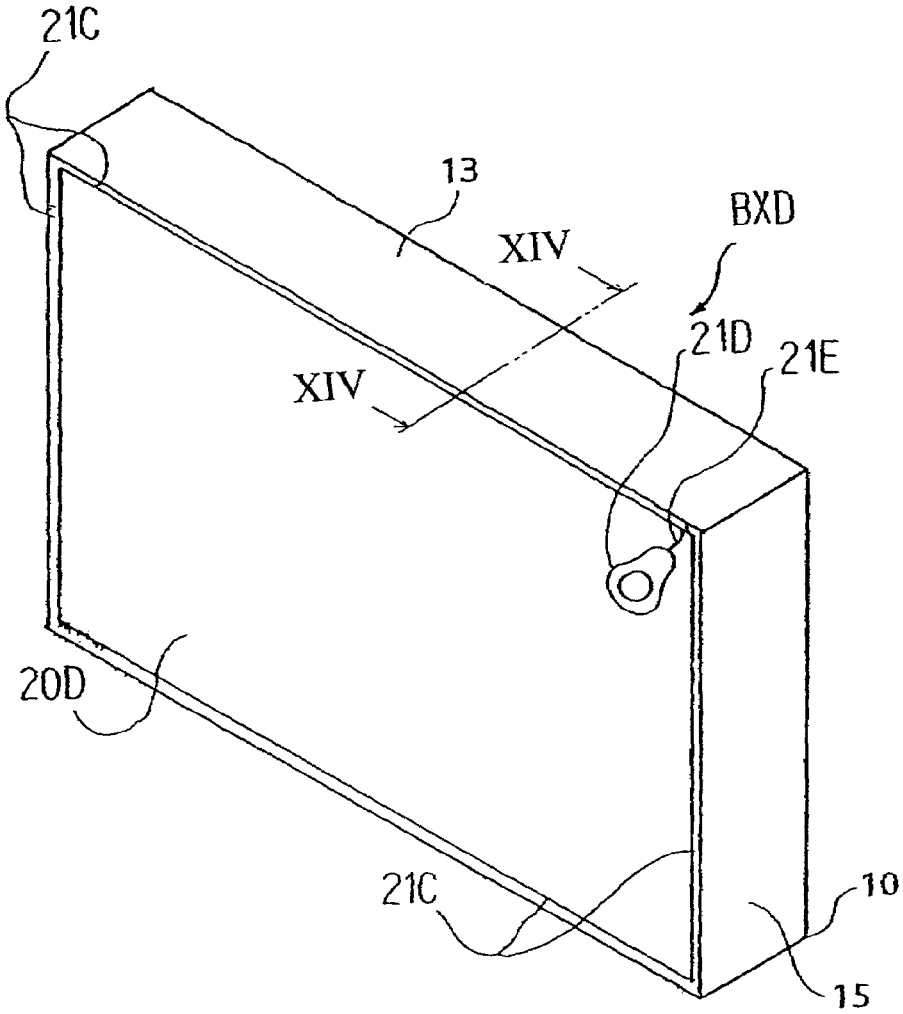
FIG. 13 is a perspective view showing a breakable wall of yet another corrugated cardboard delivery box.
Figure 14:
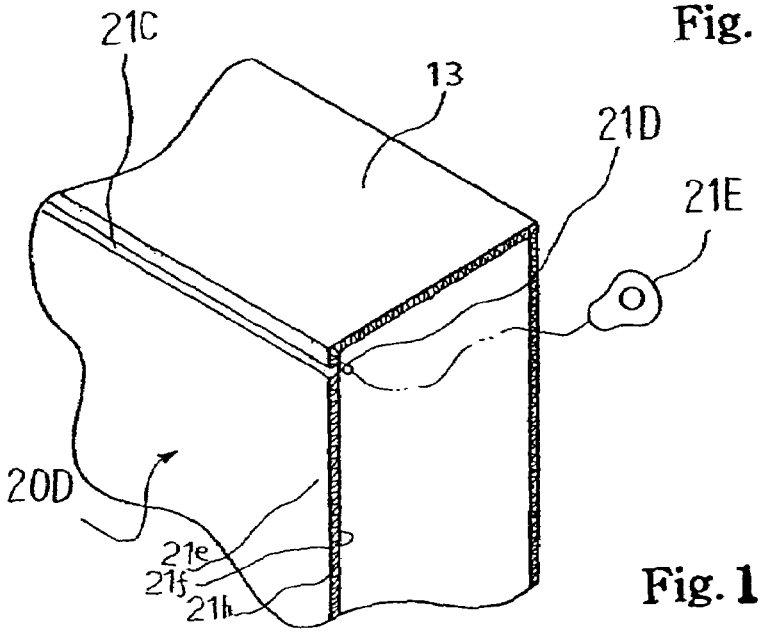
FIG. 14 is a cross sectional perspective view taken along line III—III of FIG. 13 and showing a breakable line.

FIGS. 13 and 14 show a breakable wall 20D of yet another corrugated cardboard delivery box BXD according to the present invention. The narrow grooves 21C are formed along the periphery of the breakable wall 20D, and a string 21D is adhered to the remaining sheet of paper 21*f*. A knob 21E is fixed to the leading end of the string 21D. The string 21D extends along the narrow grooves 21C. When the deliveryman breaks the wall 20D, he or she pulls the knob 21E. Then, the remaining sheet 21F is tore with the string 21D along the narrow grooves 21C so that most of the breakable wall 20D is detached from the corrugated cardboard delivery box BXD on the narrow grooves 21C. The string 21D and knob 21E may be adhered to the rear surface of a breakable wall where any narrow groove is formed.

The breakable bottom wall does not set any limit to the technical scope of the present invention. A breakable wall may form a side extent of the delivery box. In this instance, a component part or parts are attached to the side surface of the manufactured good packed in the delivery box.

Another pair of foldable lids may be further connected to the upper ends of the side walls. In this instance, the total length of the foldable lids may be less than the distance between the side walls, and the foldable lids 11A/11B are folded up onto the pair of foldable lids which has been already folded.

The staples 24 do not set any limit to the technical scope of the present invention. Pieces of packing tape or strings may be used for the foldable lids 11A/11B.

The pads 22/23, which are inserted into gaps between the corrugated cardboard delivery box and the manufactured goods, do not set any limit to the technical scope of the present invention. The pads 22/23 may be attached to the inner wall before the packing stage. Otherwise, the inner wall of the corrugated cardboard delivery box may be bent like the pads 22/23. In yet another delivery box according to the present invention, the manufactured goods may be engaged with the inner surface by means of suitable clamps or rubber bands.

The electronic piano PN does not set any limit to the technical scope of the present invention. A delivery box according to the present invention may be designed for another sort of manufactured goods such as, for example, household electric appliances and furniture. An antenna may be attached to a house-hold electric application. This means that the legs do not set any limit to the technical scope of the present invention.

Another delivery box may have an oval configuration or partially rounded. Thus, the rectangular parallelepiped delivery box does not set any limit to the technical scope of the present invention. Only two legs or more than three legs may be attached to a body as similar to the electronic piano.

A breakable wall may have plural portions to be removed from the delivery box. For example, perforated lines define plural portions to be removed, and other perforated lines are formed between the plural portions. The deliverymen firstly detach the plural portions on the perforated lines, and attach the legs to the bottom board. Thereafter, the deliverymen break the other perforated lines. Then, the piano body is taken out from the lower opening. While the deliverymen is attaching the legs to the piano body through the small openings, the remaining breakable wall prevents the piano body from dropping out from the delivery box.

Claim languages are correlated with the component parts of the packages embodying the present invention as follows. The electronic piano PN is corresponding to "goods", and the piano body 30 and legs 33A/33B/33C serve as "body" and "at least one attachment". The front wall 13, rear wall 12, side walls 14/15 and foldable lids 11A/11B are corresponding to "plural walls", and the bottom walls 20, 20A, 20B, 20C and 20D serve as "breakable wall".

The perforated lines 21, lines of dots 21B, narrow grooves 21C and peripheral portion to which the string 21D is adhered serve as "breakable route", and most of the bottom wall inside the perforated lines 21 and etc. is corresponding to "remaining portion".

What is claimed is:

1. A musical instrument and a delivery box for packing the musical instrument, the musical instrument being separable into a body having a cross section asymmetrical with respect to centerlines crossing each other at right angle and at least one attachment therein, the delivery box comprising:

plural walls defining an inner space;

a pad structure provided among said plural walls in such a manner as to make said inner space have a cross-section corresponding to said cross section of said body so that at least said body is housed in said inner space in an attitude that said cross section of said body is overlapped with said cross section of said inner space; and a breakable wall connected to said plural walls, and having a breakable route weaker than a remaining portion of said breakable wall, said breakable wall being adapted to be faced with a portion of said body to which said at least one attachment is to be connected on the condition that said body takes said attitude in said inner space.

2. The delivery box as set forth in claim 1, in which perforated lines are formed in said breakable route so that said remaining portion of said breakable wall is detached on the perforated lines.

3. The delivery box as set forth in claim 2, in which said perforated lines extend in a boundary between said breakable wall and at least one of said plural walls contiguous to said breakable wall so that said remaining portion has an area equal to or greater than an area of said portion of said body when said body is housed in said space.

4. The delivery box as set forth in claim 1, said pad structure has at least one pad inserted between said body and an inner surface of said delivery box.

5. The delivery box as set forth in claim 4, in which said at least one pad and another pad are inserted between a curved surface of said body and a flat inner surface of said delivery box so as to prevent said body from rattling.

6. The delivery box as set forth in claim 1, in which one of said plural walls is formed by at least one foldable lid so that said goods are inserted into an opening uncovered with said at least one foldable lid.

7. The delivery box as set forth in claim 6, in which said opening is closed with said at least one foldable lid, and a binder keeps said at least one foldable lid closed.

8. The delivery box as set forth in claim 7, in which said binder is staples implanted into said at least one lid.

9. The delivery box as set forth in claim 1, further comprising at least one band wound thereon.

10. The delivery box as set forth in claim 1, in which said attachment serve as legs of said musical instrument to be attached to a bottom portion of said body of said musical instrument.

11. The delivery box as set forth in claim 1 said pad structure is formed by pads, and said pads are inserted between a curved surface of said body and flat inner surfaces of said plural walls when said body of said musical instrument is housed in said inner space.

12. The delivery box as set forth in claim 10, in which said plural walls are adapted to house said legs in said inner space together with said body of said musical instrument.

* * * * *